US010011414B2

(12) United States Patent
Gamundi Masque

(10) Patent No.: US 10,011,414 B2
(45) Date of Patent: Jul. 3, 2018

(54) OPENING/CLOSING DEVICE FOR A DISPOSABLE FLEXIBLE CONTAINER

(71) Applicant: RELIEVES EGARA, SL, Terrassa (ES)

(72) Inventor: José Gamundi Masque, Terrassa (ES)

(73) Assignee: RELIEVES EGARA, SL, Terrassa (Barecelona) (ES)

( * ) Notice: Subject to any disclaimer, the term of this patent is extended or adjusted under 35 U.S.C. 154(b) by 110 days.

(21) Appl. No.: 15/028,912

(22) PCT Filed: Jun. 12, 2014

(86) PCT No.: PCT/IB2014/001030
§ 371 (c)(1),
(2) Date: Apr. 12, 2016

(87) PCT Pub. No.: WO2015/056061
PCT Pub. Date: Apr. 23, 2015

(65) Prior Publication Data

US 2016/0251136 A1 Sep. 1, 2016

(30) Foreign Application Priority Data

Oct. 15, 2013 (ES) ..... 201331173 U
Nov. 27, 2013 (ES) ..... 201331368 U
Mar. 11, 2014 (ES) ..... 201430323 U

(51) Int. Cl.
*B65D 75/28* (2006.01)
*B65D 75/58* (2006.01)
(Continued)

(52) U.S. Cl.
CPC ..... *B65D 75/5838* (2013.01); *B65D 75/12* (2013.01); *B65D 75/26* (2013.01);
(Continued)

(58) Field of Classification Search
CPC ..... B65D 75/5838; B65D 75/12; B65D 75/5894; B65D 75/5855; B65D 75/26; B65D 75/28
(Continued)

(56) References Cited

U.S. PATENT DOCUMENTS 6,026,953 A 2/2000 Nakaura et al.
2010/0154264 A1* 6/2010 Scott ..... B65D 75/5838 40/630
(Continued)

FOREIGN PATENT DOCUMENTS

DE 3542999 A1 8/1986
EP 2202176 A1 6/2010
(Continued)

*Primary Examiner* — James N Smalley
(74) *Attorney, Agent, or Firm* — Robert J. Hess; Hess Patent Law Firm

(57) ABSTRACT

The opening/closing device for a disposable flexible container includes a base sheet (1) having a first layer (1*a*) with a lower surface covered by a first adhesive (3), a second layer (1*b*) attached on the first layer (1*a*) by a second adhesive (8*a*), and contour cuts (5) defining an opening/closing flap (2) connected to the rest of the base sheet (1) by a fold line (6) that has aligned discontinuous cuts affecting both the first and second layers (1*a*, 1*b*) and the first and second adhesives (3, 8*a*). Optionally, the base sheet (1) includes a third layer (1*c*) attached on the second layer (1*b*) by a third adhesive (8*b*), and optionally the aligned discontinuous cuts of the fold line (6) also affect the third layer (1*c*).

20 Claims, 4 Drawing Sheets

(51) Int. Cl.
*B65D 75/12* (2006.01)
*B65D 75/26* (2006.01)

(52) U.S. Cl.
CPC ..... *B65D 75/28* (2013.01); *B65D 75/5855* (2013.01); *B65D 75/5894* (2013.01)

(58) Field of Classification Search
USPC ..... 206/233, 494; 220/266
See application file for complete search history.

(56) References Cited

U.S. PATENT DOCUMENTS

| | | | | |
|---|---|---|---|---|
| 2011/0163100 | A1* | 7/2011 | Ueda | B65D 75/5838 220/359.1 |
| 2012/0048857 | A1* | 3/2012 | Bando | B32B 1/02 220/260 |

FOREIGN PATENT DOCUMENTS

| | | | | |
|---|---|---|---|---|
| ES | 1058971 U | | 3/2005 | |
| JP | 2012218767 A | * | 11/2012 | B65D 75/5838 |
| WO | WO 2015/056061 A1 | | 4/2015 | |

* cited by examiner

OPENING/CLOSING DEVICE FOR A DISPOSABLE FLEXIBLE CONTAINER

FIELD OF THE ART

The present invention relates to an opening/closing device for a disposable flexible container, particularly applicable to wet wipe containers in which the moisture of the wipes must be preserved, enabling repeated use, i.e., containers provided with an opening/closing device capable of providing tight sealing when closed.

The invention is also applicable to containers for other products, such as for example, dried fruit and nut packets, infant formula sachets, chewing gum packets, pasta containers, and generally to those containers containing products that can be consumed partially on successive occasions and where the product remaining after each partial consumption needs to be kept in the container until it is used up entirely.

BACKGROUND OF THE INVENTION

Document ES 1058971 U discloses an opening/closing device for a disposable flexible container for wet wipes or other products. The flexible container is made of a sheet of impermeable flexible material arranged in the form of a flat tubular bag closed at its ends by two transverse seams and has a dispensing opening on one side through which the wet wipes are dispensed. The opening/closing device comprises an adhesive base sheet placed against a portion of the flexible container covering said dispensing opening. Said base sheet incorporates two symmetrical contour cuts separating a central collapsible flap under which there is located the dispensing opening and two narrow perimetral frame portions remaining glued to the laminar surface of the packet at all times. The collapsible flap is connected to the base sheet by a fold line acting as a hinge and has a non-adhesive gripping tab on one side thereof opposite said fold line. The mentioned symmetrical contour cuts have opposing curved end terminations between which the fold line of the central flap is defined.

The cited document ES 1058971 U has several drawbacks. Firstly, the configuration of the mentioned opposing curved terminations at the ends of the symmetrical contour cuts are stress concentrators located in the flap opening limit, which involves the risk of the base sheet material tearing and the opening/closing flap separating from the rest of the base sheet and the container if the applied force is not adjusted in moderation when opening same. Secondly, the simple fold line connecting the collapsible flap to the base sheet and acting as a hinge may not be sufficient to provide the flexibility required for the collapsible flap to remain in the open position, which means that the flap tends to close spontaneously during the operation for extracting wet wipes.

Document ES 2421381 T3 discloses an opening/closing device for a disposable flexible container comprising a flexible base sheet which, when in use, is adhered to a flexible wall of the disposable flexible container covering a dispensing opening formed therein. This base sheet has one or more contour cuts defining an opening/closing flap which is connected to the rest of the base sheet by a fold line and has a lower surface covered by a re-adherable adhesive, such that said opening/closing flap is movable between a closed position, in which the opening/closing flap is adhered to an area of the flexible wall around said dispensing opening closing same, and an open position, in which the opening/closing flap is raised, providing free access to the dispensing opening. The contour cuts include curved end portions extending outwardly with respect to the opening/closing flap and towards an end of the base sheet opposite the fold line. The base sheet comprises a lower layer and an upper layer attached to one another by an adhesive, and said fold line is formed by a continuous cut completely affecting said lower layer of the base sheet but not affecting said upper layer.

One drawback of the opening/closing device of document ES 2421381 T3 is that the upper layer must have a relatively high flexibility in order to effectively perform hinge functions, given that an excessively flexible upper layer would be incapable of keeping the opening/closing flap in the open position. If the lower layer has a relatively high rigidity to confer required consistency to the opening/closing flap, this rigidity of the material is a drawback when, as often occurs, printing is to be performed on a sheet supplied from a reel from which the lower layer of the base sheet is formed.

DISCLOSURE OF THE INVENTION

The present invention contributes to mitigate the foregoing and other drawbacks by providing an opening/closing device for a disposable flexible container, comprising a flexible base sheet which, when in use, is adhered to a flexible wall of the disposable flexible container covering a dispensing opening formed therein.

The mentioned base sheet has one or more contour cuts defining an opening/closing flap connected to the rest of the base sheet by a fold line and provided with a lower surface covered by a first adhesive, which can be a re-adherable adhesive, i.e., an adhesive which, when applied as a thin layer on a surface, allows being adhered to and removed from another surface multiple times, or a permanent adhesive envisaged for being adhered to a silicone varnish applied on the flexible wall of the disposable flexible container with a performance equivalent to that of a re-adherable adhesive.

The opening/closing flap is movable around said fold line between a closed position, in which the opening/closing flap is adhered to an area of the flexible wall around a dispensing opening closing same, and an open position, in which the opening/closing flap is raised, providing free access to the dispensing opening. The fold line acts like a hinge for the opening/closing flap movements between the closed and open positions.

In a first embodiment, the base sheet is made of two layers of plastic material and comprises a first layer adhered to the flexible wall of the container and a second layer attached on the first layer by a second adhesive. In this case, both the plurality of aligned discontinuous cuts forming the fold line and the one or more contour cuts defining the opening/closing flap affect both first and second layers of the base sheet.

In this first embodiment, the upper layer, i.e., the second layer, is of an impermeable protective material and optionally, the first layer is of a material that can be printed on. When the first layer is a printed layer, the second layer and the second adhesive are transparent.

In a second embodiment, the base sheet is made of three layers and comprises a first layer adhered to the flexible wall of the container, a second layer attached on the first layer by a second adhesive and a third layer attached on the second layer by a third adhesive, and both the aligned discontinuous cuts of the fold line and said one or more contour cuts affect all three first, second and third layers. The second layer of the base sheet preferably has a thickness and/or rigidity greater than the thickness and/or rigidity of the first layer, and optionally the third layer of the base sheet has a thickness and/or rigidity less than the thickness and/or rigidity of the first layer.

In a third embodiment, the base sheet also comprises three layers including a first layer adhered to the flexible wall of the container, a second layer attached on the first layer by a second adhesive and a third layer attached on the second layer by a third adhesive, and the one or more contour cuts defining the opening/closing flap affect all three first, second and third layers. However, in this third embodiment the aligned discontinuous cuts of the fold line only affect the first layer and the second layer, but they do not affect the third layer.

In any one of the second and third embodiments, the third layer is of an impermeable protective material and optionally the first layer or the second layer is of a material that can be printed on. When the first layer or the second layer is a printed layer, the layer or layers and the adhesive or adhesives located above the printed layer are transparent.

The construction of the fold line by means of aligned discontinuous cuts facilitates the opening/closing flap movements between the closed and open positions and allows the opening/closing flap to be kept in the open position without having to be held.

The mentioned contour cuts defining the opening/closing flap preferably include in any of the first, second and third embodiments curved end portions intersecting with opposite ends of the fold line and extending from said opposite ends of the fold line outwardly with respect to the opening/closing flap and towards an end of the base sheet opposite the fold line. The fold line is preferably substantially tangent to both curved end portions at points thereof farthest away from said end of the base sheet opposite the fold line.

Thus, the possible stresses generated in the intersections between the contour cuts and the fold line in the base sheet when the opening/closing flap is open as far as it can open with excessive force are distributed throughout the mentioned curved end portions of the contour cuts and are absorbed by the portions of the base sheet permanently adhered to the flexible wall of the container, thereby preventing the base sheet from tearing. Furthermore, the fact that the fold line is formed by a plurality of aligned discontinuous cuts affecting at least the first and second layers of the base sheet provides suitable flexibility to the fold line so that the collapsible flap is kept in the open position without any tendency to spontaneously close.

In any of the embodiments, the opening/closing flap preferably has a gripping tab located on a side thereof opposite said fold line, and said gripping tab is free of the first adhesive or has an anti-adherent treatment on the first adhesive such that in no case will it be adhered to the flexible wall of the container.

The base sheet also preferably has a surrounding portion encircling the opening/closing flap except a portion thereof corresponding to at least part of the gripping tab, and this surrounding portion, when in use, is permanently adhered to the flexible wall of the disposable flexible container. Thus, the gripping tab is always available, even when the opening/closing flap is in the closed position.

Optionally, the contour cuts include two opposing curved portions that are convex with respect to the opening/closing flap, conferring an almost circular or elliptical configuration to the opening/closing flap.

The dispensing opening is generally formed by incomplete die cutting in the flexible wall of the container, such that the dispensing opening is initially closed, by way of a seal, by a portion of the flexible wall of the container corresponding to the dispensing opening. When the opening/closing flap is opened for first time, the mentioned portion of the flexible wall of the container corresponding to the dispensing opening, which is adhered to the lower surface of the opening/closing flap by the corresponding first adhesive, is pulled off by breaking the seal and it remains permanently adhered to said lower surface of the opening/closing flap.

BRIEF DESCRIPTION OF THE DRAWINGS

The foregoing and other features and advantages will become more evident from the following detailed description of several illustrative and non-limiting embodiments with reference to the accompanying drawings, in which.

DETAILED DESCRIPTION OF EXEMPLARY EMBODIMENTS

Figure 1:
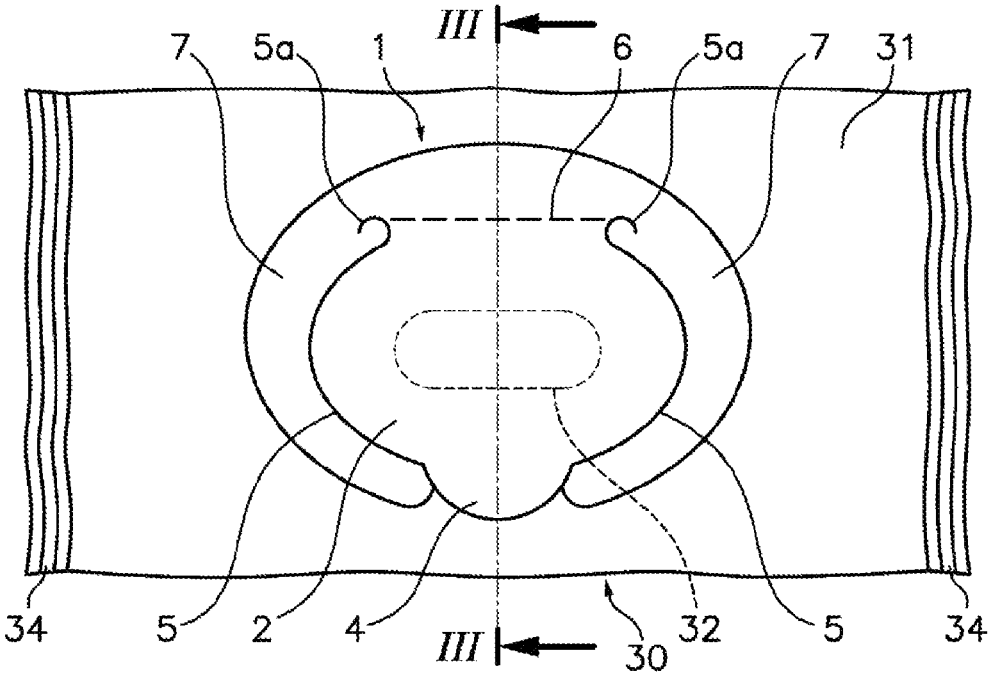
FIG. 1 is a top view of a disposable flexible container including an opening/closing device according to a first embodiment of the present invention in a closed position.

FIGS. 1 to 4 shows an opening/closing device according to a first embodiment of the present invention applied to a disposable flexible container 30, such as a wet wipe container, for example, in which the inner moisture must be maintained, which comprises a flexible wall 31 made of a sheet of impermeable plastic material arranged in the form of a flat tubular bag closed at its ends by two transverse welding seams 34. The flexible wall 31 has a dispensing opening 32 initially closed by a corresponding portion 33 of the flexible wall 31.

The opening/closing device of the present invention comprises a flexible base sheet 1 which, when in use, is adhered to the mentioned flexible wall 31 of the disposable flexible container 30 covering the dispensing opening 32. This base sheet 1 has contour cuts 5 defining an opening/closing flap 2 connected to the rest of the base sheet 1 by a fold line 6 formed by a series of aligned discontinuous cuts acting as a hinge. The opening/closing flap 2 is provided with a gripping tab 4 on one side thereof opposite said fold line 6.

A lower surface of the opening/closing flap 2 is covered by a first adhesive 3 (indicated by means of shading in FIG. 2), which can be a re-adherable adhesive or a permanent adhesive envisaged for being adhered to a silicone varnish applied on the flexible wall 31 of the disposable flexible container 30. An area corresponding to said gripping tab 4 is free of the first adhesive 3 or has an anti-adherent treatment applied on the first adhesive 3. The base sheet 1 has a surrounding portion 7 encircling the opening/closing flap 2 except a portion thereof corresponding to the gripping tab 4, and this surrounding portion 7, when in use, is permanently adhered to the flexible wall 31 of the disposable flexible container 30.

Therefore, by gripping the opening/closing flap 2 by the gripping tab 4, the opening/closing flap 2 can be moved between a closed position (FIGS. 1 and 3), in which the opening/closing flap 2 is adhered to an area of the flexible wall 31 around the dispensing opening 32, hermetically closing the dispensing opening 32, and an open position (FIGS. 2 and 4), in which the opening/closing flap 2 is raised, providing free access to the dispensing opening 32.

The contour cuts 5 defining the opening/closing flap 2 have respective opposing curved portions that are convex with respect to the opening/closing flap 2 and include curved end portions 5*a* intersecting with opposite ends of the fold line 6 and extending from said opposite ends of the fold line 6 outwardly with respect to the opening/closing flap 2 and towards an end of the base sheet 1 opposite the fold line 6. In the illustrated example, the fold line 6 is substantially tangent to both curved end portions 5*a*.

Figure 2:
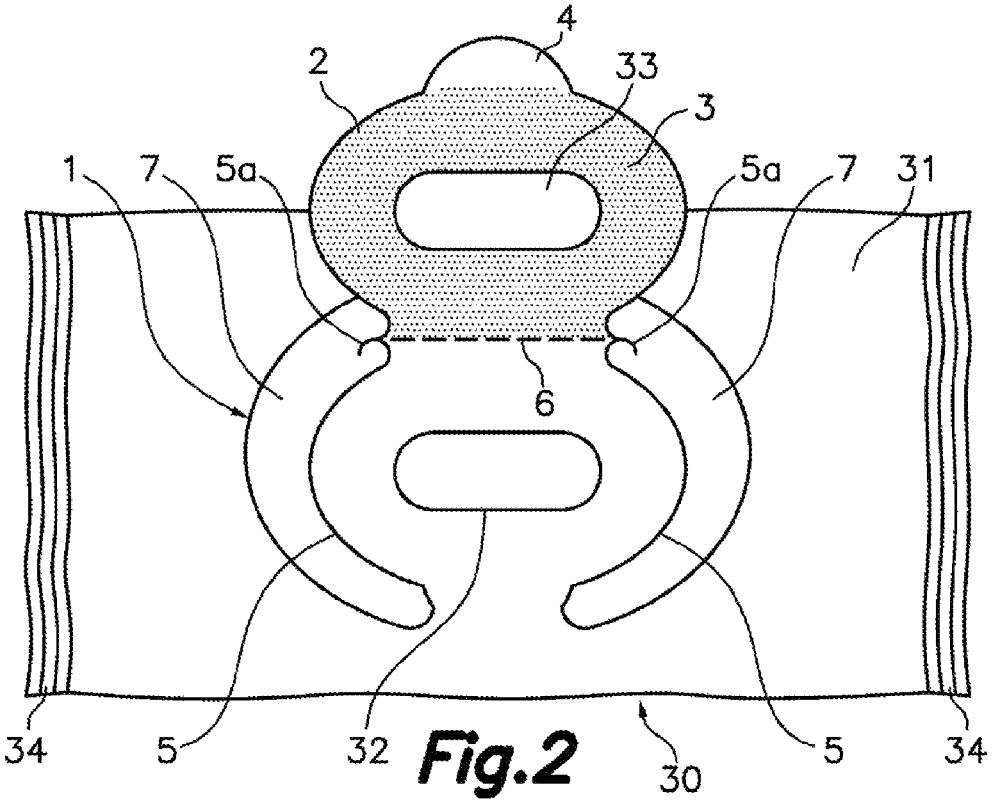
FIG. 2 is a top view of the disposable flexible container including the opening/closing device of FIG. 1 in an open position.
Figure 4:
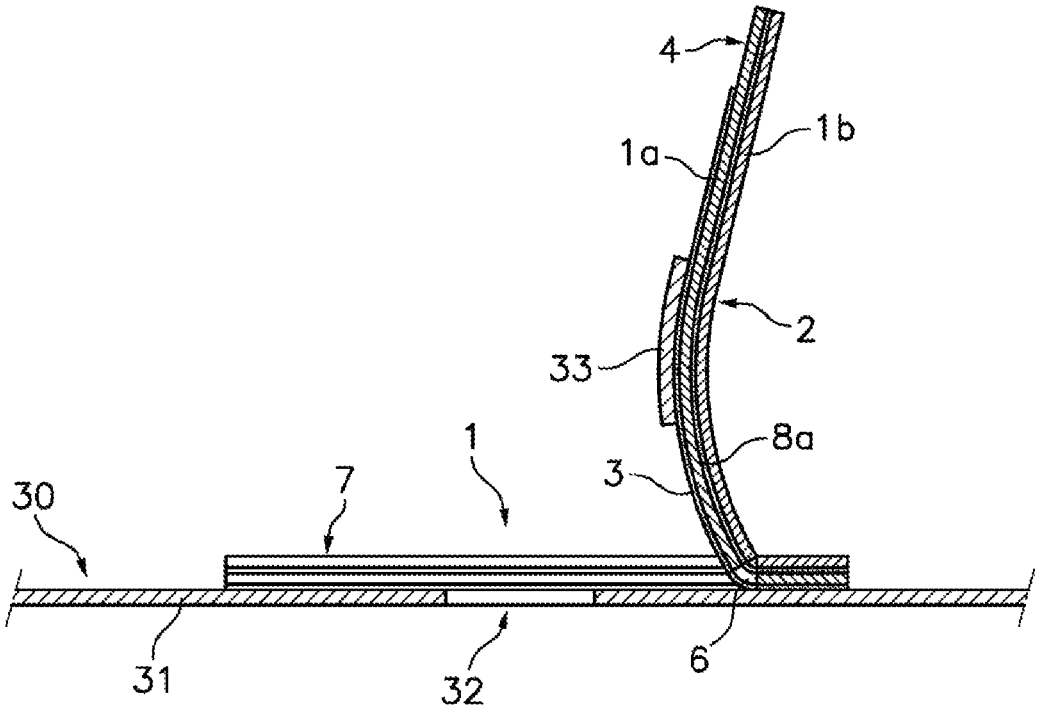
FIG. 4 is a partial cross-section view similar to FIG. 3 in the open position.

When in use, the mentioned portion 33 of the flexible wall 31 of the disposable flexible container 30 corresponding to the dispensing opening 32 is permanently adhered to the lower surface of the opening/closing flap 2 by the first adhesive 3 (FIGS. 2 and 4). This portion 33 of the flexible wall 31 is initially attached to the flexible wall 31 of the container by way of partial die cutting and is pulled off by the opening/closing flap 2 the first time said flap is opened.

Figure 3:
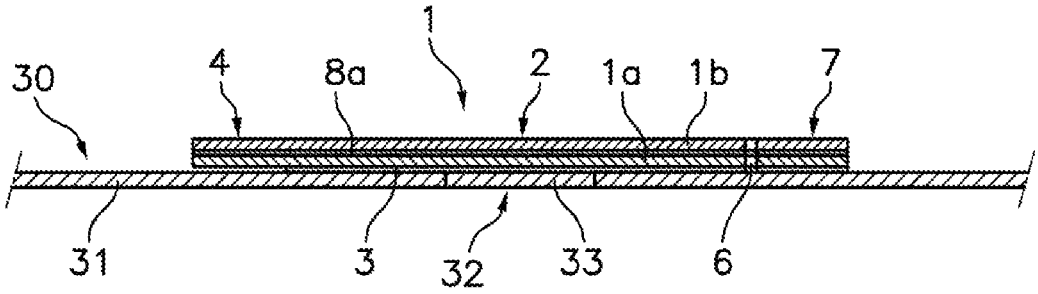
FIG. 3 is a partial cross-section view taken along plane of FIG. 1, where the thicknesses of the sheets are exaggerated to better understand the drawing.

As shown in FIGS. 3 and 4, in the first embodiment the base sheet 1 comprises two layers of plastic material, including a lower first layer 1*a* and an upper second layer 1*b* attached to one another by a second adhesive 8*a*. Both the plurality of aligned discontinuous cuts forming the fold line 6 and the contour cuts 5 defining the opening/closing flap 2 affect both first and second layers 1*a*, 1*b*, the first adhesive 3 and the second adhesive 8*a*.

Optionally, the first layer 1*a* is a printed layer and the second layer 1*b* and the second adhesive 8*a* are transparent.

Figure 5:
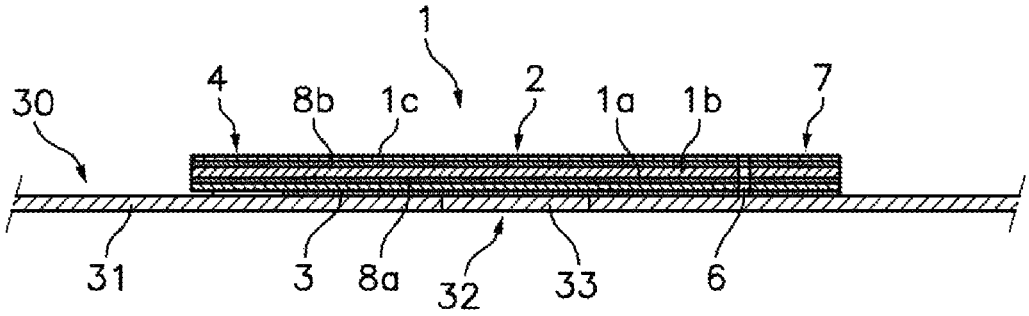
FIG. 5 is a partial cross-section view of a disposable flexible container including an opening/closing device according to a second embodiment of the present invention in a closed position, where the thicknesses of the sheets are exaggerated to better understand the drawing.
Figure 6:
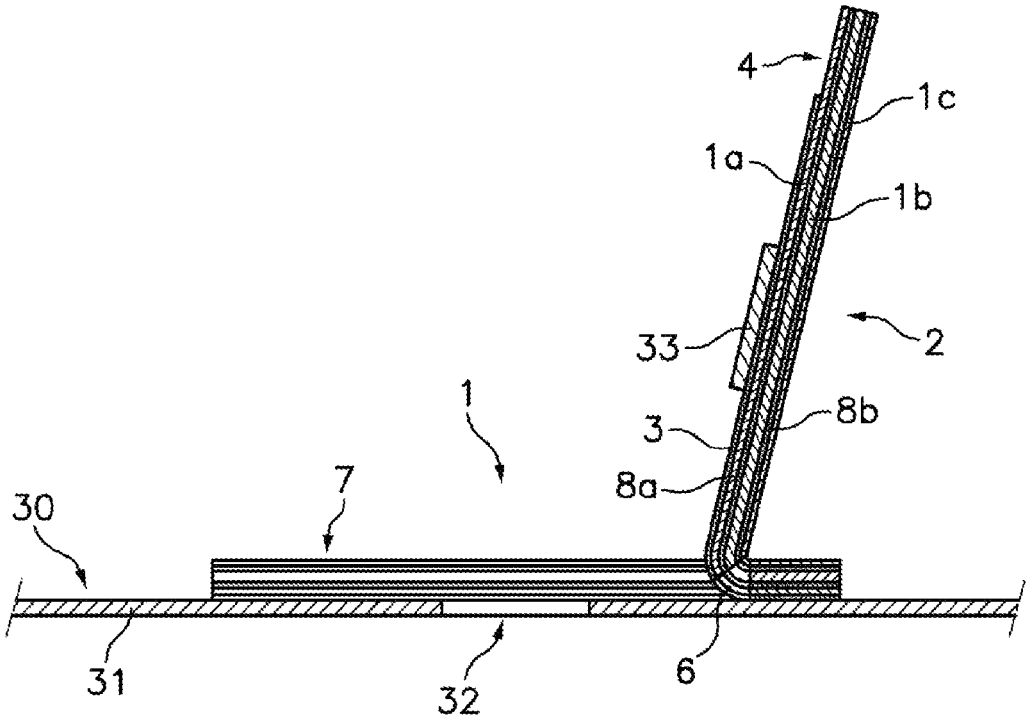
FIG. 6 is a partial cross-section view similar to FIG. 5 in the open position.

FIGS. 5 and 6 show an opening/closing device according to a second embodiment of the present invention, which is completely analogous to the first embodiment described above in relation to FIGS. 1 to 4 except that in this second embodiment, the base sheet 1 comprises three layers, including a lower first layer 1*a*, an intermediate second layer 1*b*, and an upper third layer 1*c* arranged on the second layer 1*b*. The second layer 1*b* is attached to said first layer 1*a* by a second adhesive 8*a*, and the third layer 1*c* is attached to the intermediate second layer 1*b* by a third adhesive 8*b*. The second and third adhesives 8*a*, 8*b* attaching the first, second and third layers 1*a*, 1*b*, 1*c* can be identical or different.

In this second embodiment, the fold line 6 also comprises a series of aligned discontinuous cuts, and both the aligned discontinuous cuts of the fold line 6 and the one or more contour cuts 5 affect the three layers, i.e., the first, second and third layers 1*a*, 1*b*, 1*c*, the first adhesive 3 and the second and third adhesives 8*a*, 8*b*.

In the second embodiment shown in FIGS. 5 and 6, the second layer 1*b* of the base sheet 1 preferably has a thickness and/or rigidity greater than the thickness and/or rigidity of the first layer 1*a*, and the third layer 1*c* of the base sheet 1 has a thickness and/or rigidity less than the thickness and/or rigidity of the first layer 1*a*, taking into account that the rigidity of each of the first, second and third layers 1*a*, 1*b*, 1*c* is determined by the material from which it is made in combination with the thickness thereof. Optionally, the first layer 1*a* is a printed layer and the second and third layers 1*b*, 1*c* as well as the second and third adhesives 8*a*, 8*b* are transparent, or alternatively the second layer 1*b* is a printed layer and the third layer 1*c* and third adhesive 8*b* are transparent.

Figure 7:
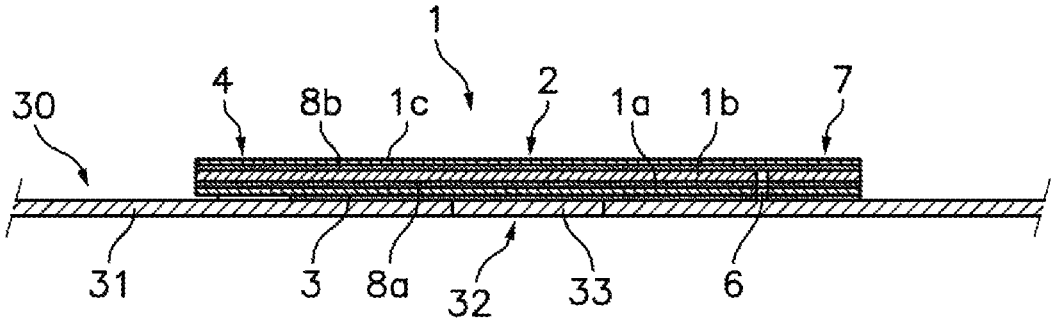
FIG. 7 is a partial cross-section view of a disposable flexible container including an opening/closing device according to a third embodiment of the present invention in a closed position, where the thicknesses of the sheets are exaggerated to better understand the drawing.
Figure 8:
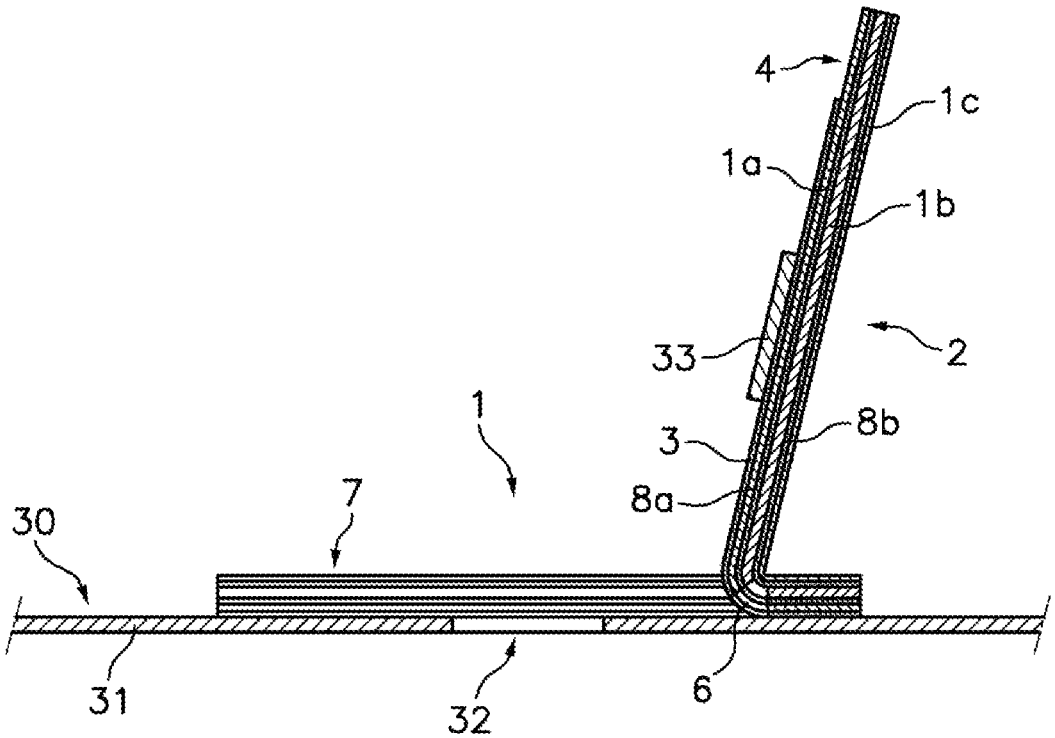
FIG. 8 is a partial cross-section view similar to FIG. 7 in the open position.

FIGS. 7 and 8 show an opening/closing device according to a third embodiment of the present invention, which is entirely analogous to the second embodiment described above in relation to FIGS. 5 and 6 except that in this third embodiment, the aligned discontinuous cuts comprised in the fold line 6 only affect the lower first layer 1*a*, the intermediate second layer 1*b*, and the first and second adhesives 3, 8*a*, but they do not affect the upper third layer 1*c*.

The scope of the present invention is defined in the attached claims.

The invention claimed is:

1. An opening/closing device for a disposable flexible container, comprising a flexible base sheet which, when in use, is adhered to a flexible wall of the disposable flexible container covering a dispensing opening formed therein, said base sheet having one or more contour cuts defining an opening/closing flap connected to the rest of the base sheet by a fold line and provided with a lower surface covered by a first adhesive, said opening/closing flap being movable between a closed position, in which the opening/closing flap is adhered to an area of the flexible wall around said dispensing opening closing same, and an open position, in which the opening/closing flap is raised, providing free access to the dispensing opening, and where the base sheet comprises a first layer which, when in use, is adhered to a flexible wall of the disposable flexible container, and a second layer attached on said first layer by a second adhesive, characterized in that the fold line comprises a plurality of aligned discontinuous cuts affecting both first and second layers of the base sheet, and both first and second adhesives.

2. The opening/closing device for a disposable flexible container according to claim 1, wherein said first adhesive covering the lower surface of the opening/closing flap is a re-adherable adhesive.

3. The opening/closing device for a disposable flexible container according to claim 1, wherein said first adhesive covering the lower surface of the opening/closing flap is a permanent adhesive envisaged for being adhered to a silicone varnish applied on the flexible wall of the disposable flexible container.

4. The opening/closing device for a disposable flexible container according to claim 1, wherein said contour cuts include curved end portions intersecting with opposite ends of the fold line and extending from said opposite ends of the fold line outwardly with respect to the opening/closing flap and towards an end of the base sheet opposite the fold line.

5. The opening/closing device for a disposable flexible container according to claim 1, wherein the base sheet comprises a third layer attached on the second layer by a third adhesive, and both the one or more contour cuts and said plurality of aligned discontinuous cuts of the fold line furthermore affect said third layer and said third adhesive.

6. The opening/closing device for a disposable flexible container according to claim 1, wherein the base sheet comprises a third layer attached on the second layer by a third adhesive, where the one or more contour cuts furthermore affect said third layer and said third adhesive, and where the aligned discontinuous cuts of the fold line do not affect the third layer of the base sheet.

7. The opening/closing device for a disposable flexible container according to claim 5, wherein the second layer of the base sheet has a thickness and/or rigidity greater than a thickness and/or rigidity of the first layer.

8. The opening/closing device for a disposable flexible container according to claim 5, wherein the third layer of the base sheet has a thickness and/or rigidity less than a thickness and/or rigidity of the first layer.

9. The opening/closing device for a disposable flexible container according to claim 1, wherein said first layer is a printed layer and the second layer and the second adhesive are transparent.

10. The opening/closing device for a disposable flexible container according to claim 5, wherein said first layer is a printed layer and the second and third layers and the second and third adhesives are transparent.

11. The opening/closing device for a disposable flexible container according to claim 2, wherein the second layer is a printed layer and the third layer and the third adhesive are transparent.

12. The opening/closing device for a disposable flexible container according to claim 1, wherein the opening/closing flap has a gripping tab located on a side thereof opposite said fold line.

13. The opening/closing device for a disposable flexible container according to claim 12, wherein said gripping tab is free of said first adhesive.

14. The opening/closing device for a disposable flexible container according to claim 12, wherein said gripping tab has an anti-adherent treatment applied on said first adhesive.

15. The opening/closing device for a disposable flexible container according to claim 12, wherein the base sheet has a surrounding portion encircling the opening/closing flap except at least part of said gripping tab, said surrounding portion, when in use, being permanently adhered to the flexible wall of the disposable flexible container.

16. The opening/closing device for a disposable flexible container according to claim 1, wherein the fold line is substantially tangent to both curved end portions.

17. The opening/closing device for a disposable flexible container according to claim 6, wherein the second layer of the base sheet has a thickness and/or rigidity greater than the thickness and/or rigidity of the first layer.

18. The opening/closing device for a disposable flexible container according to claim 6, wherein the third layer of the base sheet has a thickness and/or rigidity less than the thickness and/or rigidity of the first layer.

19. The opening/closing device for a disposable flexible container according to claim 6, wherein said first layer is a printed layer and the second and third layers and the second and third adhesives are transparent.

20. The opening/closing device for a disposable flexible container according to claim 7, wherein said first layer is a printed layer and the second and third layers and the second and third adhesives are transparent.

* * * * *